US006736400B1

(12) United States Patent
Cesternino

(10) Patent No.: US 6,736,400 B1
(45) Date of Patent: May 18, 2004

(54) AUTOMATIC TARGET DEVICE

(76) Inventor: Joseph M. Cesternino, 28 Cesternino La., Ghent, NY (US) 12075

( * ) Notice: Subject to any disclaimer, the term of this patent is extended or adjusted under 35 U.S.C. 154(b) by 0 days.

(21) Appl. No.: 10/350,652

(22) Filed: Jan. 24, 2003

(51) Int. Cl.[7] ..... F41J 9/02
(52) U.S. Cl. ..... 273/366
(58) Field of Search ..... 273/359, 366–370, 273/386–392

(56) References Cited

U.S. PATENT DOCUMENTS

| | | | | | |
|---|---|---|---|---|---|
| 387,411 | A | * | 8/1888 | Gisel | 273/366 |
| 399,604 | A | * | 3/1889 | Dufner et al. | 273/366 |
| 718,865 | A | * | 1/1903 | Northcraft | 273/366 |
| 1,061,577 | A | | 5/1913 | Whitney | |
| 1,121,945 | A | * | 12/1914 | Smith | 273/366 |
| 1,250,215 | A | * | 12/1917 | Panos | 273/368 |
| 1,736,244 | A | * | 11/1929 | Baker | 273/368 |
| 1,902,040 | A | | 3/1933 | Meyer | |
| 1,907,181 | A | * | 5/1933 | Fey | 273/366 |
| 1,927,876 | A | * | 9/1933 | Meyer | 273/366 |
| 2,125,353 | A | | 8/1938 | Mattson | 273/105.2 |
| 2,232,743 | A | * | 2/1941 | Swenson | 273/368 |
| 2,297,993 | A | * | 10/1942 | Tratsch | 273/366 |
| 2,479,354 | A | | 8/1949 | Hanson | 273/105.2 |
| 2,510,380 | A | * | 6/1950 | Clifford | 273/366 |
| 3,163,420 | A | * | 12/1964 | Braun | 273/366 |
| 3,406,969 | A | | 10/1968 | Tisdell et al. | 273/1 |
| 3,550,941 | A | * | 12/1970 | Lloyd et al. | 273/375 |
| 3,572,712 | A | | 3/1971 | Vick | 273/86 |
| 3,914,879 | A | | 10/1975 | Taylor, III et al. | 35/25 |
| 4,042,242 | A | * | 8/1977 | Nicholls et al. | 273/368 |
| 4,072,313 | A | * | 2/1978 | Murso et al. | 273/359 |
| 4,076,247 | A | | 2/1978 | Kim et al. | 273/105.6 |
| 4,340,370 | A | | 7/1982 | Marshall et al. | 434/22 |
| 4,890,847 | A | | 1/1990 | Cartee et al. | 273/406 |
| 5,358,254 | A | * | 10/1994 | Yeh | 273/366 |
| 5,367,232 | A | | 11/1994 | Netherton et al. | 318/3 |

* cited by examiner

*Primary Examiner*—Mark S. Graham
(74) *Attorney, Agent, or Firm*—Heslin Rothenberg Farley & Mesiti P.C.; Lee Palmateer, Esq.

(57) ABSTRACT

An automatic target device having targets hingedly mounted to a endless loop conveyor which is driven by a variable speed, remotely controllable drive motor around an endless track having a target track where the targets are presented for target practice and a return track where the return track is lower than the target track, and having a target rail that targets slide upon and that holds the targets in an upright position along the target track. The target device makes an efficient use of gravity to maintain upright targets in an upright position and to reset toppled targets into the upright position. The target device includes a forwardly canted deflector plate to protect the device. The deflector plate, endless loop conveyor and target rail may all be canted forward in substantially parallel planes thereby allowing for a compact mechanism and facilitating portability. A method for providing moving targets is also disclosed.

70 Claims, 8 Drawing Sheets

AUTOMATIC TARGET DEVICE

TECHNICAL FIELD

The present invention relates to target devices, and more particularly, to automatic moving target devices.

BACKGROUND OF THE INVENTION

People take target practice for refinement of shooting skills, for enjoyment and for sport. Automatic target devices that provide moving targets can make target practice more challenging and more fun. An example of such a device is one typically seen in amusement parks. Such amusement park target devices are contained in large booths and are designed for use with non-lethal projectiles such as corks or balls. These devices typically have multiple, spaced-apart targets mounted to an endless conveyor that moves the targets at a constant speed, horizontally across the booth along a target track in front of the shooter. The targets are typically made of sheet metal or other materials suitable for withstanding the small impact forces. Struck targets fall backward and are reset into their upright position by an abrupt ramp positioned in the target's path, causing the target to be suddenly uprighted against the forces of gravity. After a target completes its travel across the target device, it travels out of the shooter's view along a return track to a point where it begins the next pass in front of the shooter.

Other types of automatic target devices having targets mounted to a moving conveyor are suitable for target practice with firearms. They are typically large devices and require careful, cumbersome set-up. As with the previously described amusement target device, one must typically travel to the location where the target device is installed.

Still other automatic target devices are suitable for target practice with firearms and are portable. As with the other types of target devices mentioned, they require cumbersome set up operations.

There is a need for a rugged, simple, compact and portable automatic target device which is suitable for shooting with firearms, which requires little or no set up operations, which can be carried by a person and easily transported in a typical passenger vehicle or light pick-up truck to a location selected by the user, and which is compatible with a readily available portable power supply such as a car battery.

SUMMARY OF THE INVENTION

In a first aspect, the present invention provides an automatic target device for receiving projectiles from a projectile source. The device has a frame and an endless loop conveyor system mounted to the frame. The endless loop conveyor system has an endless loop conveyer configured for movement around a predetermined endless track. The track has a target track and a return track. The target track is higher than the return track. The device also has a source of motive power to drive the conveyor. The device also has at least one target having a target end and a connector end. The target is hingedly connected at its connector end to the conveyor. The target can rotate, between at least an upright position and a toppled position, about an axis at the hinged connection that is substantially parallel to the direction of movement of the target along the target track. The device also has a target rail that includes a target support portion and a transition portion. The target support portion is positioned adjacent to the target track of the conveyor so that an upright target will lean forwardly thereon toward the projectile source and will slide thereon as the target moves along the target track. The transition portion of the target rail is positioned adjacent to at least a portion of the return track of the conveyor and is shaped so that a passing target will lean and slide thereon in an upright position as the target approaches the target track.

In a second aspect, the present invention provides a method of presenting moving targets for target practice by providing a frame, an endless loop conveyor, a source of motive power to drive the conveyor, at least one target, and a target rail having a target support portion and a transition portion. More particularly, the method includes providing an endless loop conveyor system having an endless loop conveyor configured for movement around a predetermined endless track that has a target track portion and a return track portion wherein the target track is higher than the return track. The method also includes mounting the endless loop conveyor system to the frame and providing a source of motive power to drive the conveyor. The method further includes hingedly connecting the connector end of the target to the conveyor so that the target is rotateable between at least an upright position and a toppled position about an axis substantially parallel to the target's direction of movement along the track. The target support portion of the target rail is positioned adjacent to the target track of the conveyor so that an upright target will lean forwardly thereon toward the projectile source and slide thereon as the target moves along the target track. The transition portion of the target rail is positioned adjacent to at least a portion of the return track of the conveyor and is shaped so that a passing target will lean and slide thereon in an upright position as the target approaches the target track.

These, and other features and advantages of this invention will become apparent from the following detailed description of the various aspects of the invention taken in conjunction with the accompanying drawings.

BRIEF DESCRIPTION OF THE DRAWINGS

The subject matter that is regarded as the invention is particularly pointed out and distinctly claimed in the concluding portion of the specification. The invention, however, may be best understood by reference to the following detailed description of various embodiments and the accompanying drawings in which:

DETAILED DESCRIPTION OF THE INVENTION

Figure 1:
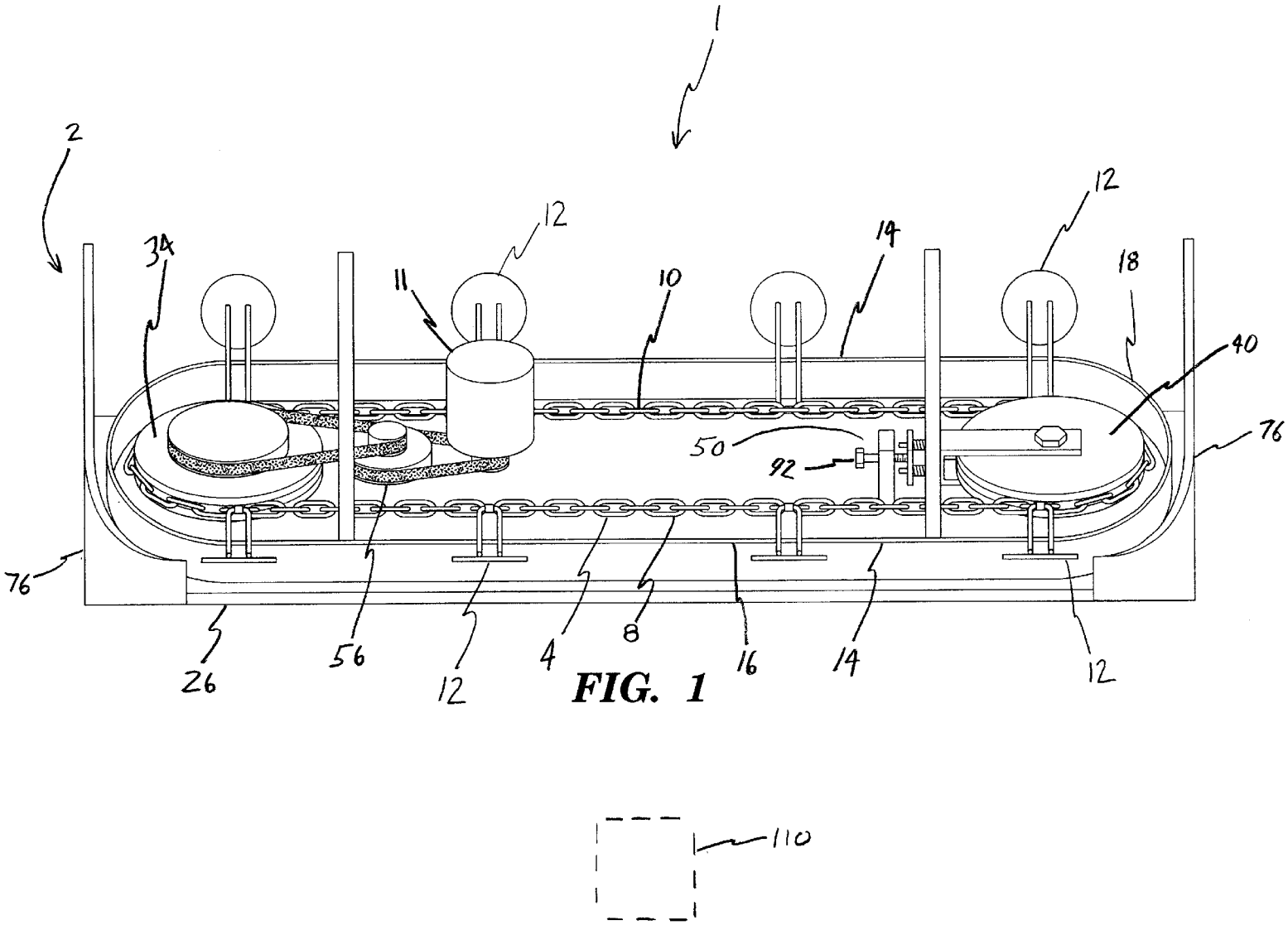
FIG. 1 is a top view of a target device in accordance with the present invention with the rear housing and conveyor guide removed to expose other details.
Figure 2:
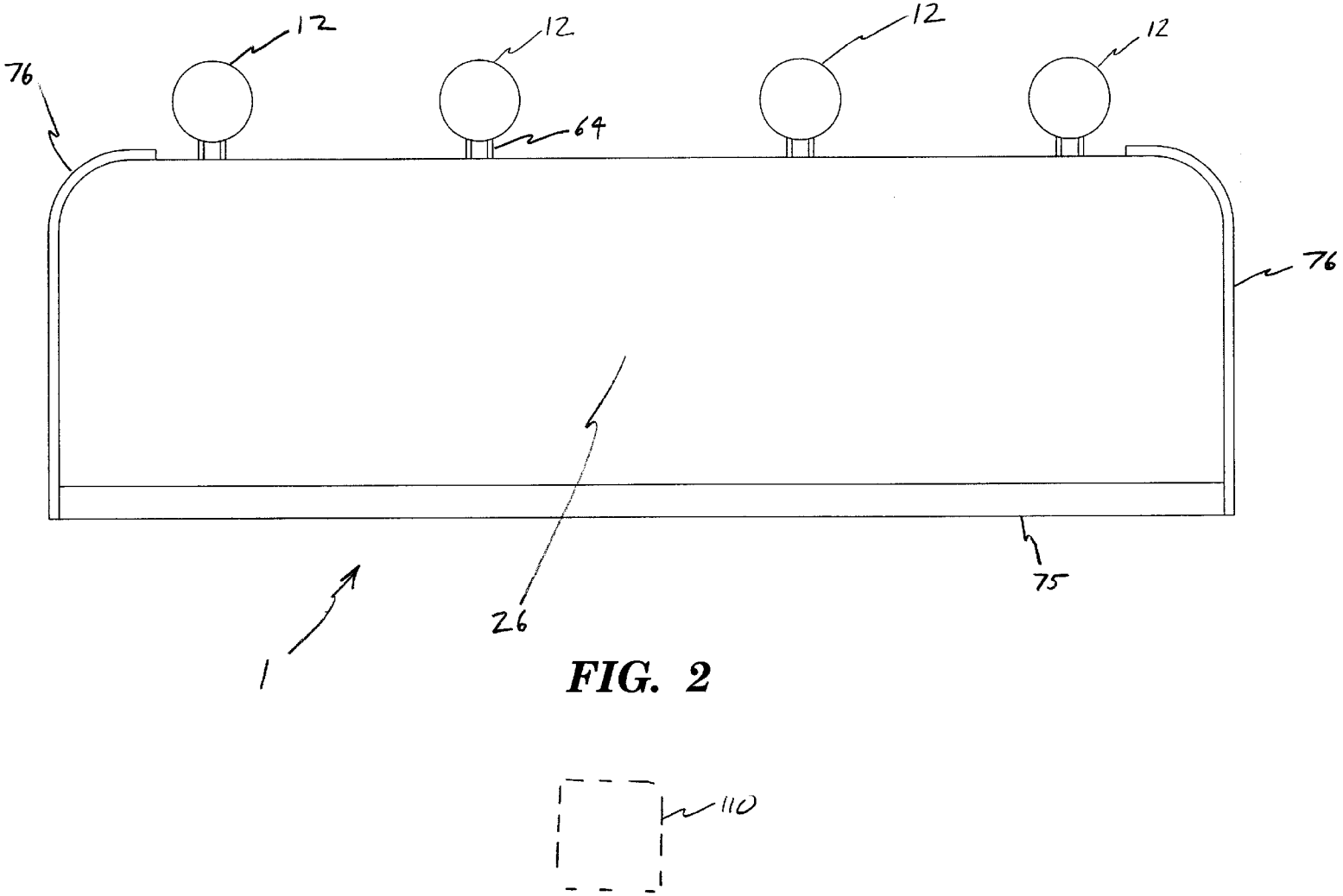
FIG. 2 is a front view of the target device of FIG. 1.
Figure 4:
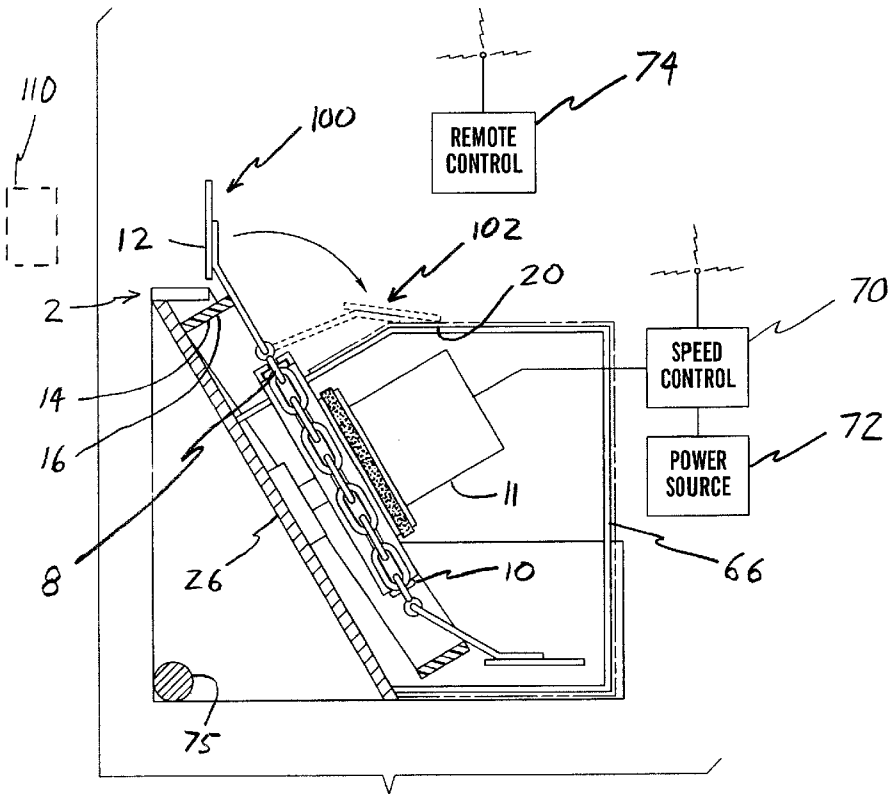
FIG. 4 is a partial cut away side view of the target device of FIG. 1.
Figure 3:
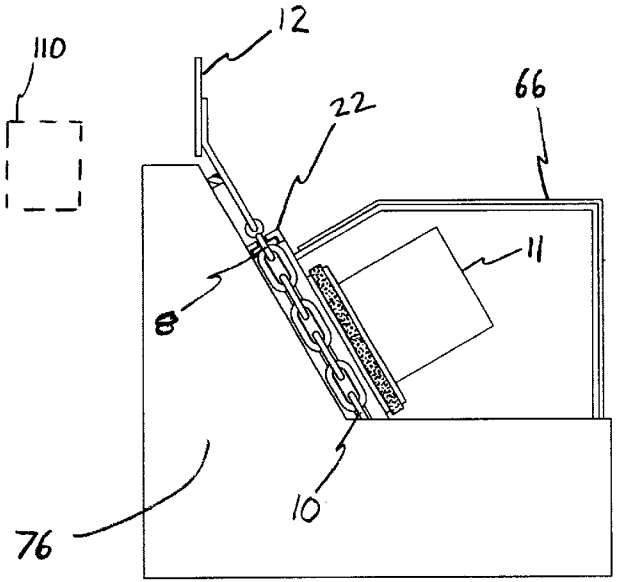
FIG. 3 is a side view of the target device of FIG. 1 with a partial cut away of the rear housing.
Figure 7:
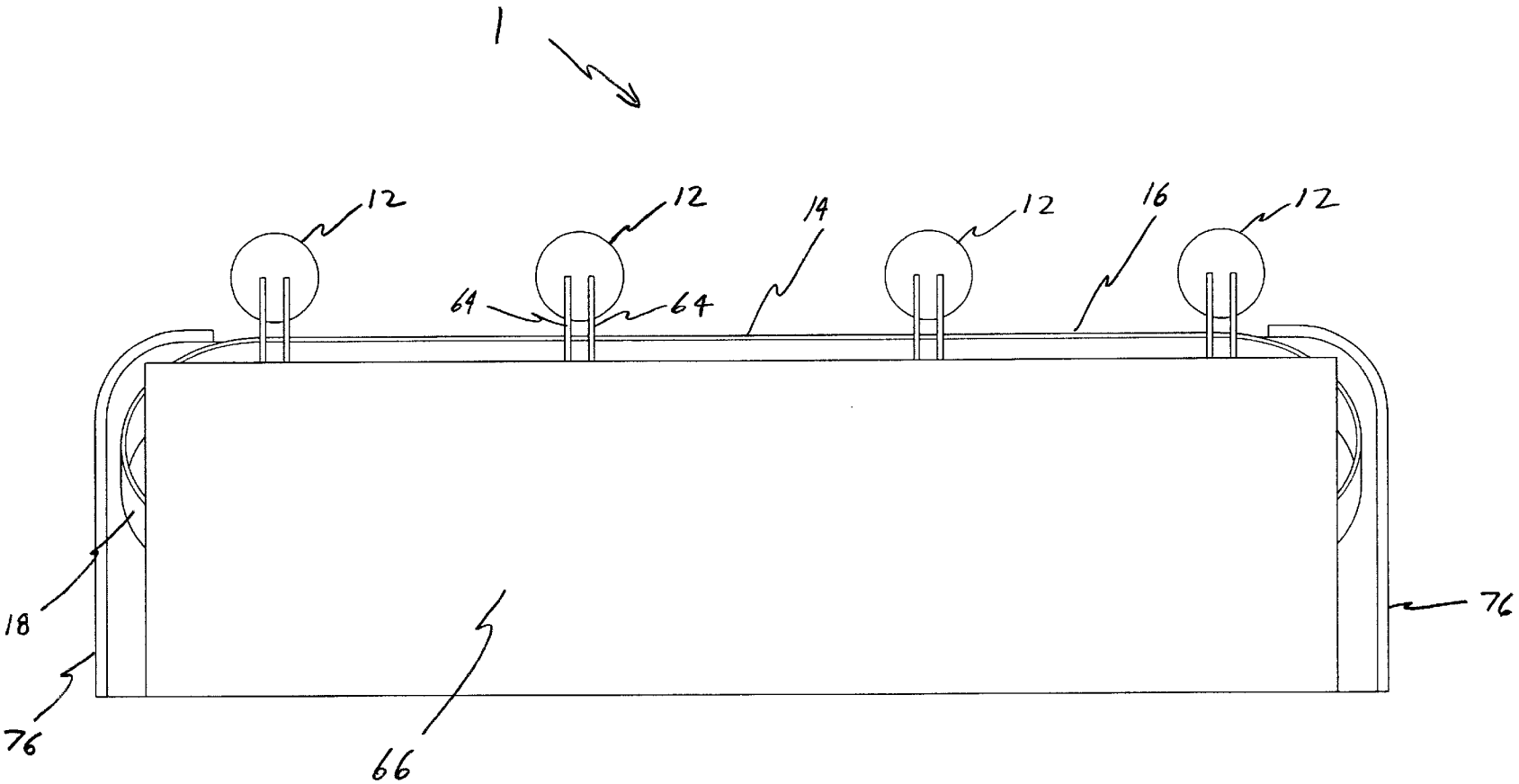
FIG. 7 is a rear view of the target device of FIG. 1.
Figure 8:
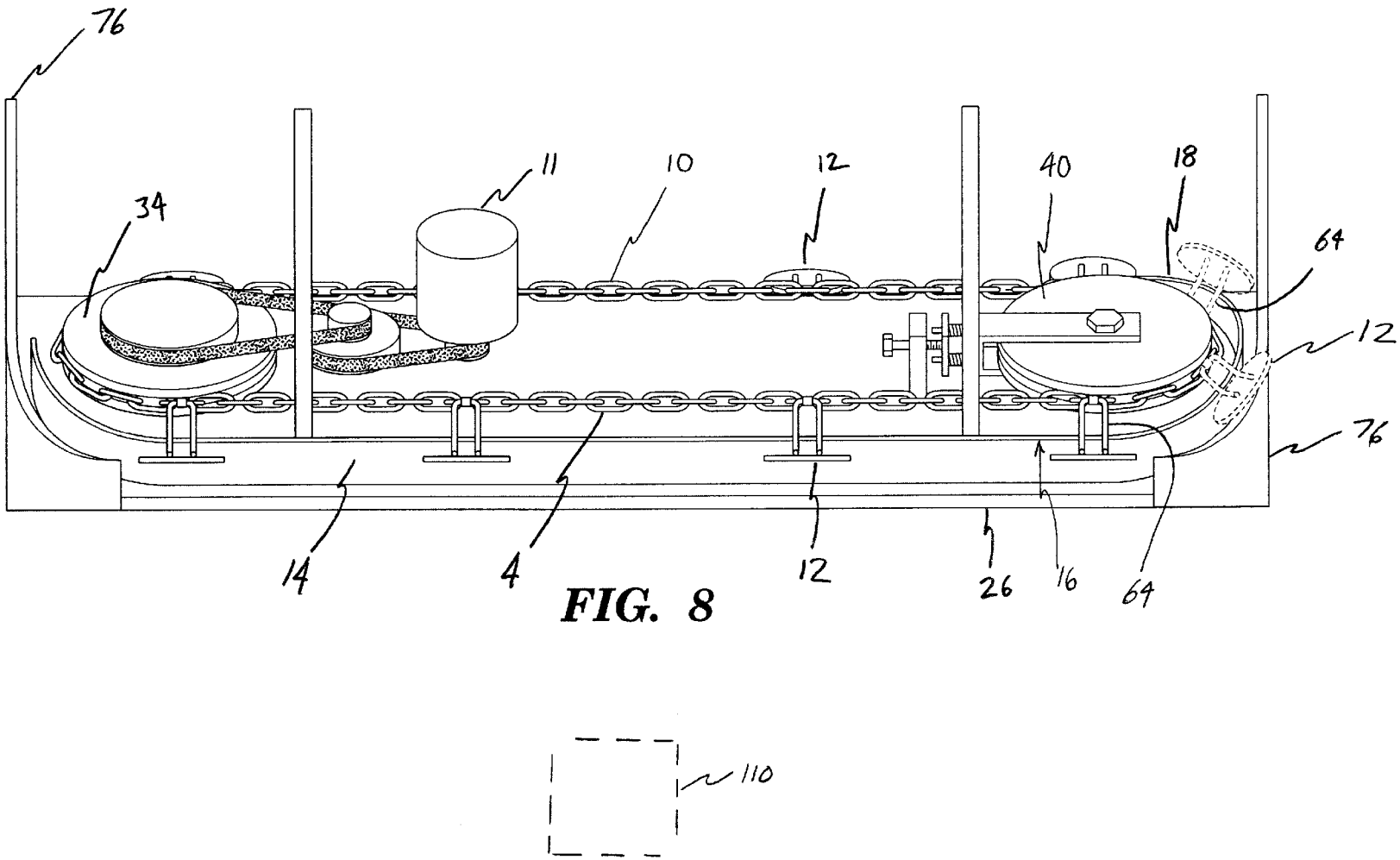
FIG. 8 is a top view of an alternate embodiment of the target device of the present invention.

FIGS. 1 through 4 and 7 and illustrate an automatic target device in accordance with the present invention. FIG. 1 is a top view of the target device. FIG. 3 is a side view of the target device of FIG. 1, with the addition of a rear housing 66 shown partially cut away. FIG. 4 is a cross sectional view of the target device of FIG. 3, with the addition of a speed control 70, power source 72, and remote control 74. FIGS. 2 and 7 are front and rear views, respectively, of the target device. FIG. 8 is a top view of an alternate embodiment of the target device, which dispenses with a portion of the target rail 14 and which is different than the embodiment having a continuous target rail shown in FIG. 1.

The present invention overcomes some of the limitations of currently available target devices. It provides an a rugged, simple, compact and portable automatic target device which is suitable for target practice with firearms, requires little or no set up operations, can be carried by a person and easily transported in a typical passenger vehicle to a location selected by the user, and which is compatible with readily available portable power supplies such as a car battery. The present invention provides for an efficient use of space and for a simple, smooth and efficient means of moving, presenting, and resetting targets. As a result, the present invention provides for greater compactness, ruggedness, portability, and simplicity of use than do other target devices.

With reference to FIG. 1, targets 12 are mounted to a conveyor 4. The conveyor is a flexible conveyor, in the shape of an endless (or continuous) loop. The conveyor may be a standard link chain, cable, belt, bicycle chain, or other devices suitable for forming into a flexible, continuous loop. The conveyor 4 is configured for movement around an endless track which is the path in space through which the conveyor travels. In the case of an endless conveyor such as a chain, the shape of the conveyor defines the endless track. The conveyor loops around a drive pulley 34 and an idler pulley 40. The drive pulley drives the conveyor around the endless track. The drive pulley is driven by a source of motive power 11 which may be a DC motor, an AC motor, or any other suitable source of motive power. The source of motive power (or "motor") may be adapted for connection with an electrical power source such as, for example, a typical automobile battery.

The target track 8 is thought of as the forward portion of the endless track, extending from the drive pulley 34 to the idler pulley 40, where a target 12 is presented to the shooter for target practice. The remainder of the endless track is the return track 10. With reference to FIGS. 3 and 4, it may be seen that the target track 8 is higher than the return track 10 in the preferred embodiment, which is significant because it enables the device to take advantage of gravity to reset toppled targets as will be more fully appreciated from the description below. In alternate embodiments, the target track may be in positions not higher than the return track.

With further reference to FIG. 1, a target rail 14 is positioned near the endless track of the conveyor 4. The portion of the target rail that is adjacent to the target track 8 is called the target support portion 16, and the remainder of the target rail is called the transition portion 18. The target rail may be made of synthetic wear resistant material, metal, or other wear resistant materials suitable for sliding contact.

With Reference to FIG. 2, the target device 1 has two side panels 76 connected to the deflector plate 26 and an elongated member 75 connecting the side panels to each other.

Figure 5:
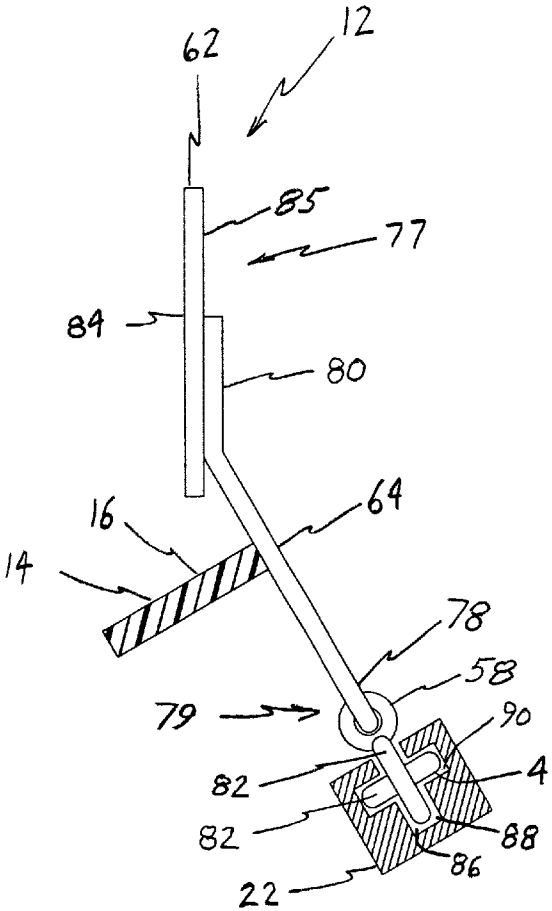
FIG. 5 is a side view of a target, chain link conveyor, cylindrical sleeve connected to the conveyor, and a cross section of a conveyor guide and target rail in accordance with the present invention (although the conveyor guide is not shown in FIG. 1, it is considered to be part of the preferred embodiment)
Figure 9:
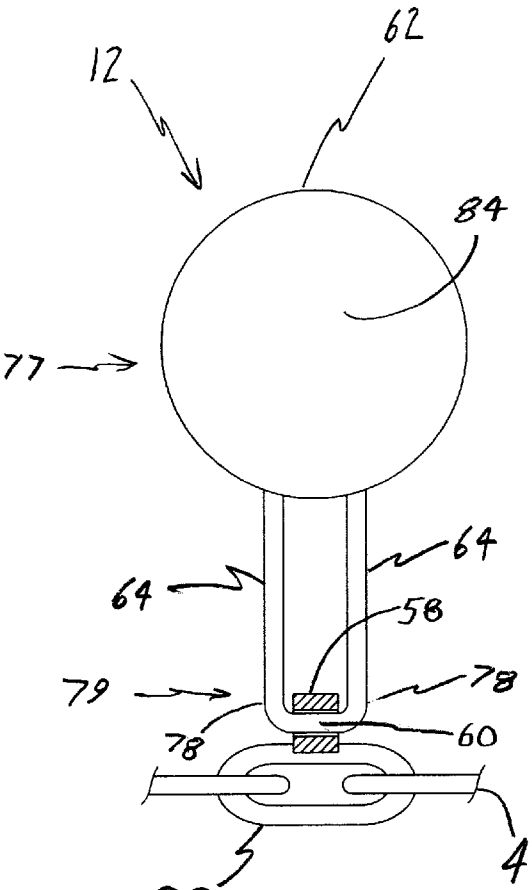
FIG. 9 is a front view of the target, conveyor and cylindrical sleeve of FIG. 5.

As best shown in FIG. 5 and FIG. 9, the target 12 has a target end 77 and a connector end 79. The target comprises a target plate 62, a support rod 64 having a distal end 80 connected to the target plate and a proximal end 78 connected to an axial rod 60 (FIG. 9). The axial rod fits inside a cylindrical sleeve 58 which is attached to the conveyor 4. Thus the target is hingedly attached to the conveyor. The conveyor may be a standard link chain and the cylindrical sleeve may be attached to a link 82 in the chain. The support rod 64 is shaped so that the target plate will be substantially vertical when an upright target is leaning against the target support portion 16 of the target rail 14.

The target plate 62 may be made of steel plate or other suitable material for withstanding bullet impacts without significant plastic deformation. The remainder of the target may also be of sturdy steel construction, or similarly suitable construction so as to withstand high impact loads. Likewise, all parts of the device that may experience direct or indirect shock loads from projectiles may be made of steel or other suitable materials.

With reference again to FIG. 1, the targets 12 that are shown in a position on the target track 8 are shown in the their upright position, leaning forwardly against the target support portion 16 of the target rail 14. As the targets move along the target track, they slide on the target rail.

The transition portion 18 of the target rail 14 is shaped and positioned adjacent to the return track portion 10 of the endless track so that an upright target 12 entering the transition portion will remain leaning on the target rail for the entire travel around the endless track. A target will remain leaning on the target rail by operation of gravity (and at high speeds, centrifugal forces in portions of the endless track which, for example, go around a pulley) unless and until the target is acted upon by a sufficient outside force to overcome the gravity (and, in some instances, centrifugal) forces.

The endless track of the conveyor 4 and target rail 14 may both lie substantially in respective planes. The planes of the endless track and target rail may be canted forwardly so that the target track is closer to the projectile source 110 than the return track. The plane of the target rail 14 and the plane of the endless track of the conveyor 4 may be parallel. The target rail may be disposed circumferentially outwardly of the conveyor. The endless track and target rail may also be in other orientations and positions so long as the conveyor and the target rail are in such relative orientation so that an upright target 12 will lean forwardly on the target rail unless and until an external force is imparted on the target.

FIG. 8 illustrates an alternate embodiment of the automatic target device of the present invention. As opposed to the preferred embodiment which has a continuous target rail, this alternate embodiment dispenses with portions of the target rail and deploys a truncated transition portion 18 of the target rail 14. Targets 12 are allowed to freely hang when they are in positions along portions of the return track 10. In FIG. 8, the target rail is configured for use with targets moving clockwise in the figure, i.e., from right to left along the target track. The transition portion 18 of the target rail 14 is shaped and positioned so that its leading end, i.e., the end most proximal to an approaching hanging target, is positioned forwardly of the support rod 64 of the target. Although it is partially blocked by the idler pulley 40, if the pulley were removed from the figure, the leading end of the transition portion would be seen to be positioned, for example, forward of the return track 10. The transition portion gradually slopes from its leading end to a point where it meets the target track 8 so that, as a hanging target approaches the idler pulley 40, it slidably encounters the transition portion 18 and is gradually cammed to its upright position as it further slides along the transition portion for a smooth transition to the target support portion 16 of the target track.

With reference to FIG. 4, a target in the upright position 100 that is struck by a projectile from the projectile source 110 (or shooter) may fall backward to the toppled position 102. For example, with reference to FIG. 5, a target hit by a projectile on the front surface 84 of the target plate 62 may rotate backwardly, i.e., in the direction in which the back surface 85 of the target plate faces. When referring to the direction of rotation of the target, forward is toward the front surface 84 of the target plate, and backward is toward the opposite (or back) surface 85 of the target plate, regardless of the target's position on the endless track. When referring to the target device generally, forward is in the direction of the shooter 110 (FIG. 1), for example the direction in which the front surface 84 of the target plate faces when the target is on the target track 8.

Referring again to FIG. 4, a toppled target on the target track will lean on and slide along a slide pad 20 which extends substantially parallel to, or otherwise in conformity with, the target track 8 and ends at a position beyond the end of the target track so that when a target proceeds beyond the end of the slide pad, gravity will cause it to rotate forwardly and, in the case of FIG. 1, return to a position leaning forwardly on the transition portion 18 of the target rail (in the case of FIG. 8, it will rotate to a hanging position). Centrifugal forces will also tend to rotate the target forwardly. Thus, the target device makes efficient use of, and works with gravity to maintain the position of upright targets and to reset toppled targets.

With further reference to FIG. 5, the target device of the present invention may have a conveyor guide 22. FIG. 5 illustrates a side view of a target 12, conveyor 4, cylindrical sleeve 58, and a cross section of a conveyor guide 22. The conveyor guide has an interior channel 86 through which the conveyor travels, thereby providing torsional and lateral stability and support for the conveyor. The conveyor guide may be attached to the frame and is positioned proximal to the endless track, such as proximal to the target track 8 (FIG. 1). The conveyor guide may have sub-channels 88 and 90 oriented perpendicularly to each other for receiving links 82 of a standard link chain conveyor. There may be more than one conveyor guide located proximally to different portions of the endless track, for example there may be one proximal to the return track 10 (FIG. 1). The conveyor guide 22 may be made of synthetic wear resistant material, metal, or other wear resistant materials suitable for sliding contact.

With further reference to FIG. 1 and FIG. 4, the present invention may include a deflector plate 26. The deflector plate is attached to the frame 2 so as to shield the device from projectiles, except targets 12 that are exposed above the top of the deflector plate along the target track 8. The deflector plate 26 may be forwardly canted so as to downwardly deflect or downwardly direct projectiles received from the projectile source 110. The deflector plate may be parallel to the plane of the target rail and the plane of the endless track of the conveyor. Positioning the conveyor, the target rail and the deflector plate in similarly oriented planes provides for a compact automatic target device. The deflector plate may provide a convenient structure upon which to mount the other components of the target device, thus being part of the frame. The deflector plate may be made of steel plate or other suitable materials to withstand high projectile impact forces (or loads).

Figure 6:
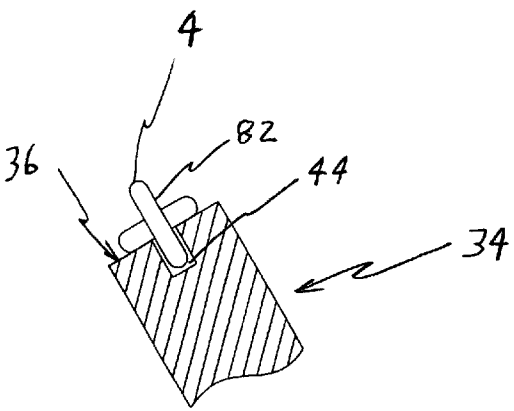
FIG. 6 is a side view of a chain link conveyor engaged with the outer circumferential surface of a drive pulley and with links of the chain received by a groove in the drive pulley in accordance with the present invention.

FIG. 6 illustrates a partial cross sectional view of drive pulley 34 of the present invention having an outer circumferential surface 36 and a centrally disposed recess 44 for receiving the conveyor so as to maintain stable alignment of the conveyor with the drive pulley. The recess may be a groove for receiving links 82 of a standard link chain. The recess extends around the circumference of the pulley. Although the recess is shown and described to be centrally disposed, it is understood that it may be other than centrally disposed. The idler pulley has the same configuration as shown in FIG. 6.

With further reference to FIG. 1, the drive pulley 34 and idler pulley 32 are connected to the frame in any conventional manner such as, for example, welding, and are rotatable about their respective axes. They may be connected to the deflector plate 26, which may constitute part of the frame. The drive pulley is connected to the drive motor 11 which turns the drive pulley 34 in order to move the conveyor 4 around the endless track.

The idler pulley 40 is connected to the frame (or deflector plate which may form part of the frame) by an adjustable suspension means 50 used for absorbing shock and transient loads in the conveyor and for adjusting tension in the conveyor. Tension in the conveyor can be increased by turning the threaded adjuster 92 in one direction and decreased by turning the threaded adjuster in the opposite direction. This allows the user to adjust the amount of slippage between the conveyor and the drive pulley.

The source of the motive power 11 may be a variable speed electric drive motor, capable of turning the drive pulley at various speeds, having a rotary shaft and adapted for electrical connection to an electric power source 72, for example a 12 volt DC power source. The drive shaft may be connected to the drive pulley by a motor gear reduction system 56, for example providing a 22:1 gear reduction.

With further reference to FIG. 4, the drive motor may be remotely controllable by using a remote control device 74 which may be either wired to a speed control device 70 connected to the drive motor 11 or which may transmit signals such as radio or infrared signals through the air to the speed control device.

The target device of the present invention may include additional drive pulleys or idler pulleys and the circuit may have various configurations.

The target rail or portions thereof may be integral with other components of the target range such as, for example, the deflector plate. Likewise, the slide pad or portions thereof may be integral with the housing of the target range.

Although in the preferred embodiment, the target track is in a straight line, the target track may undulate so that the targets are presented at different heights along the target track. Likewise, although the endless track is illustrated in the preferred embodiment to lie substantially in a single plane, it may have segments that are in different planes and the target rail may have segments in different planes corresponding to the segments of the endless track.

Figure 10:
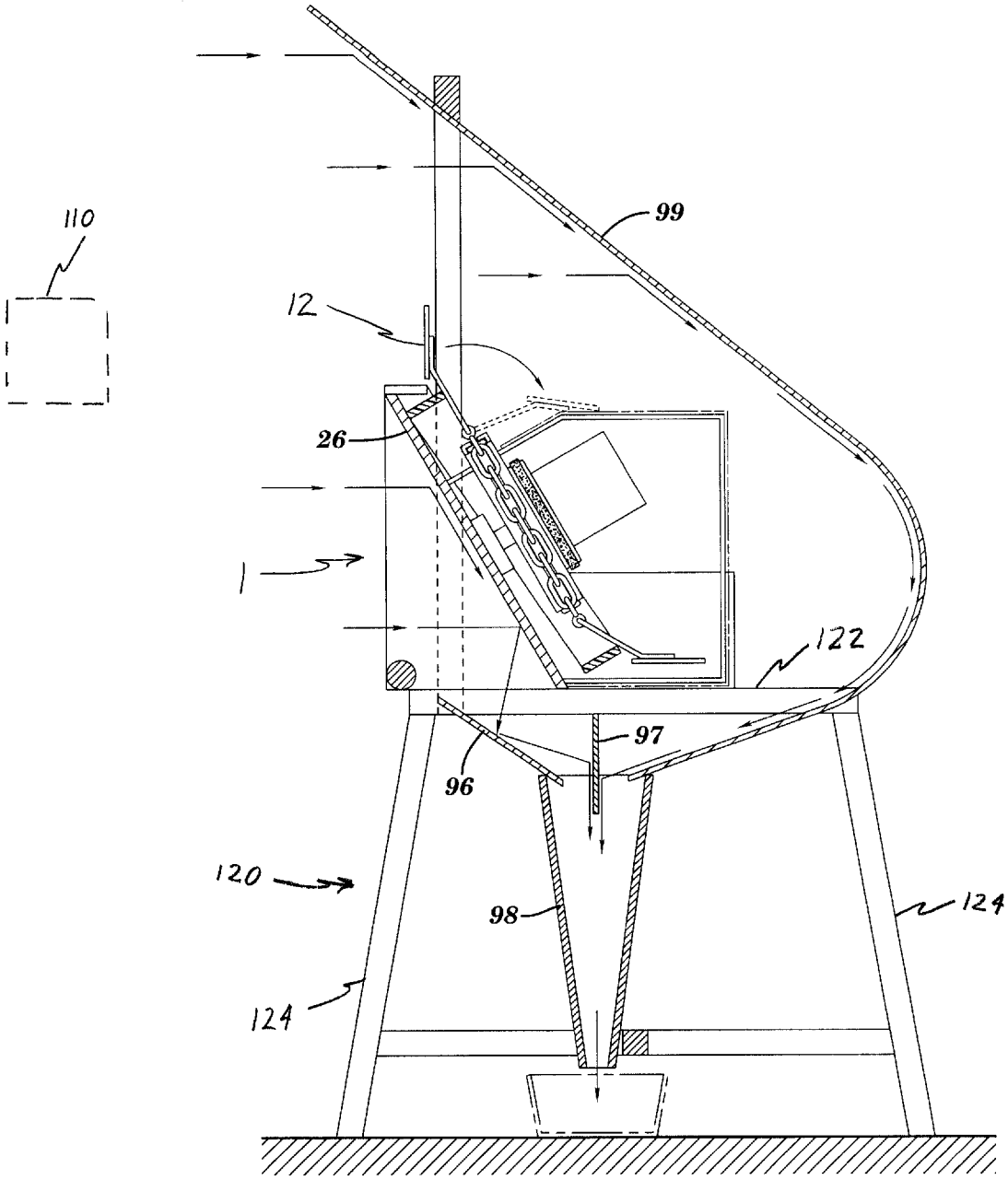
FIG. 10 is a side view of the target device of FIG. 1 with a projectile trap and peripheral projectile trap in accordance with the present invention.

With reference to FIG. 10, the automatic target device may have a projectile trap 94 attachable to the frame and disposed below deflector plate 26 so as to catch projectiles downwardly deflected or directed by said deflector plate. The trap includes a deadener plate 96 and a vertical barrier plate 97. The deadener plate is disposed underneath the deflector plate and is canted at a shallower angle than the deflector plate so as to slow down the deflected or directed projectiles and redirect their descent into the trap. The vertical barrier plate 97 substantially halts horizontal movement of projectiles before the projectiles fall into the trap. The trap may have a funnel 98 so as to funnel projectiles into a small area so that they can be deposited directly into a receptacle, such as can, placed thereunder.

The automatic target device may have a peripheral projectile trap 99 attachable to the frame and configured so as to catch projectiles that pass by the target 12 and deflector plate 26.

Figure 11:
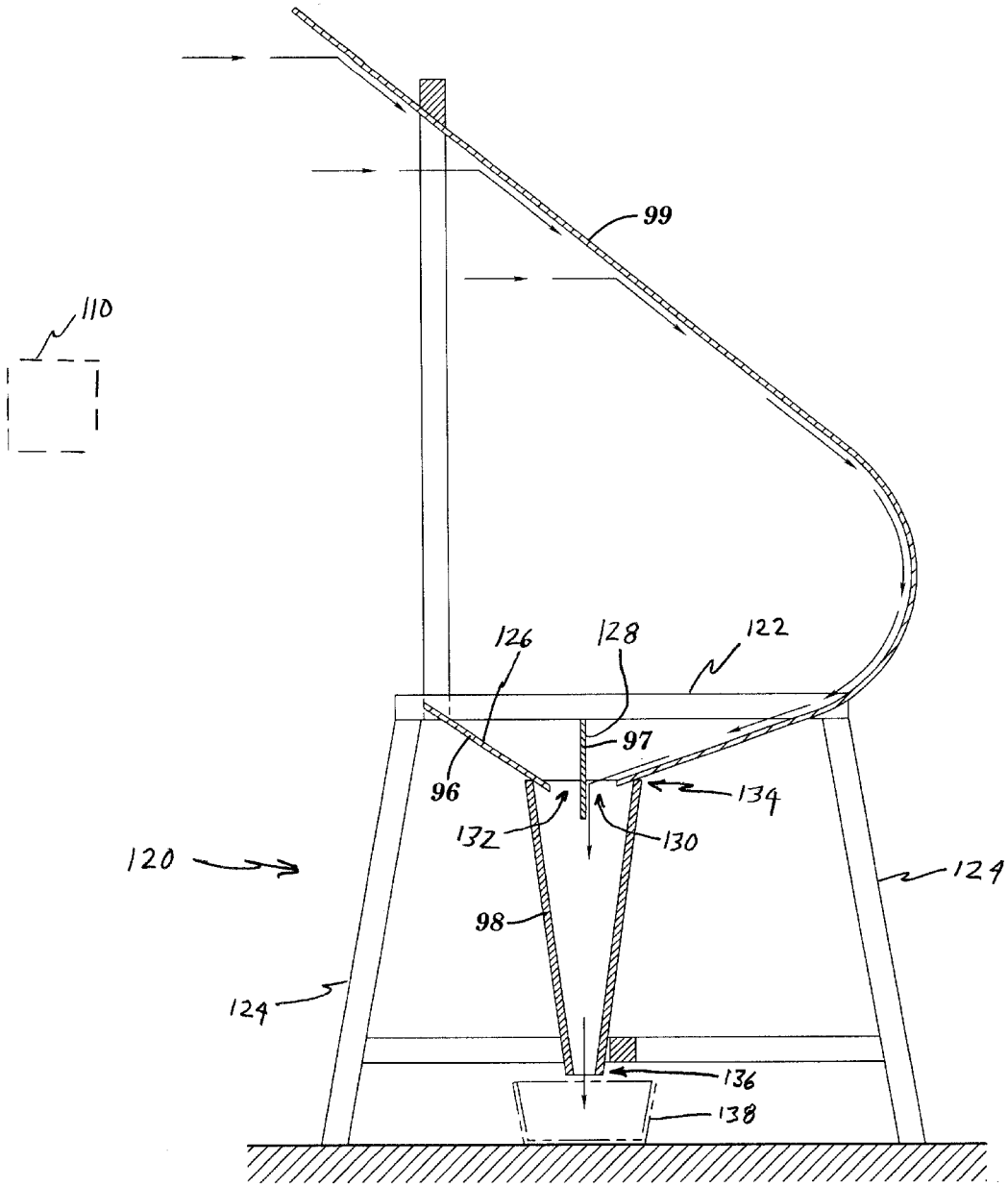
FIG. 11 is a side view of a projectile trap device having projectile trap and peripheral projectile trap in accordance with the present invention.

With reference to FIG. 11, the projectile trap and peripheral projectile trap may be attached to a stand 120. The a stand has two parallel elongated horizontal support members 122 of substantially equal length disposed in a horizontal plane and defining opposite sides of a rectangle wherein one horizontal support member is disposed on the right side of the rectangle and one horizontal support member (not shown in the figure) disposed on the left side of the rectangle. An elongated connecting member (not shown in the figure) is attached at one end to the right horizontal support member and at one end to the left horizontal support member, and a plurality of vertical support members 124 downwardly depending from said horizontal support members so as to support a target device placed upon the horizontal support members 122.

A bottom projectile trap is attached to the stand and includes an elongated deadener plate 96 extending across the stand perpendicularly to the horizontal support members 122 and attached at one end to the right horizontal support member 122 and at one end to the left horizontal support member (not shown in the figure) and canted forward at a shallow angle, said deadener plate 96 having a top surface 126 for receiving projectiles having a downward trajectory so as to substantially arrest the vertical component of the downward trajectory. An elongated vertical barrier plate 97 extends across the stand perpendicularly to the horizontal support members and attached at one end to the right horizontal support member and at one end to the left horizontal support member and having a vertical orientation and disposed a horizontal distance behind the deadener plate 97 for receiving projectiles deflected or redirected horizontally from the deadener plate so as to substantially arrest the horizontal movement of the projectile.

A peripheral projectile trap 99 is attached to and extends across the stand and is configured so as to catch projectiles that pass by a target device placed on the stand and to direct projectiles into the back surface 128 of the vertical barrier plate and wherein the peripheral projectile trap and the back surface of the vertical barrier plate form a gap 130 therebetween. A funnel 98 having a wide top opening 134 and a narrow bottom opening 136, wherein the top of the funnel is attached to the horizontal support members 122 of the stand and is disposed beneath the vertical barrier 97 plate so as to receive projectiles that fall through the gap 132 between the vertical barrier plate and deadener plate and the gap 130 between the vertical barrier plate and peripheral projectile trap 99. Projectiles are thus funneled to a point where they may be conveniently collected in a receptacle 138.

While the invention has been particularly shown and described with reference to certain embodiments, it will be understood by those skilled in the art that various changes in form and details may be made to the invention without departing from the spirit and scope of the invention as described in the following claims.

What is claimed is:

1. An automatic target device for receiving projectiles from a projectile source comprising:

a frame;

an endless loop conveyor system mounted to the frame and having an endless loop conveyor configured for movement around a predetermined endless track, a first portion of which is a target track and a second portion of which is a return track wherein the target track is higher than the return track;

a source of motive power to drive the conveyor;

at least one target having a target end and a connector end, said target being hingedly connected at its connector end to the conveyor so as to be rotatable between at least an upright position and a toppled position about an axis substantially parallel to its direction of movement along the track; and a target rail having a target support portion positioned adjacent to the target track of the conveyor so that an upright target will lean forwardly thereon toward the projectile source and slide thereon as the target moves along the target track and having a transition portion shaped and positioned adjacent to at least a portion of the return track so that a passing target will lean and slide thereon in an upright position as the target approaches the target track.

2. The automatic target device of claim 1, further comprising a slide pad positioned adjacent to the target track of the conveyor so that a toppled target will lean backwardly and slide thereon as the target moves along the target track.

3. The automatic target device of claim 1, further comprising a conveyor guide proximal to at least a portion of the target track of the conveyor and having a channel in which the conveyor moves so as to provide torsional and lateral support for the conveyor.

4. The automatic target device of claim 1 wherein the conveyor comprises a standard link chain.

5. The automatic target device of claim 1 wherein the target support portion of the target rail and the transition portion of the target rail form a continuous rail.

6. The automatic target device of claim 5 wherein the target rail is endless.

7. The automatic target device of claim 6 wherein the target rail is positioned relative to the conveyor so that an upright target will lean thereon as it moves along the entire endless track.

8. The automatic target device of claim 7 wherein the target rail is disposed circumferentially outwardly of the conveyor.

9. The automatic target device of claim 8 wherein the conveyor and the target rail each lie substantially in a respective plane.

10. The automatic target device of claim 9 wherein the plane of the target rail and the plane of the endless track of the conveyor are canted forwardly so that the target track is closer to the projectile source than the return track.

11. The automatic target device of claim 10 wherein the plane of the target rail and the plane of the endless track of the conveyor are parallel.

12. The automatic target device of claim 11, further comprising a deflector plate attached to the frame so as to shield the device from projectiles, except for the at least one target as it passes along the target track.

13. The automatic target device of claim 12 wherein the deflector plate lies in a forwardly canted plane so as to downwardly deflect projectiles received from the projectile source.

14. The automatic target device of claim 13 wherein the plane of the deflector plate is parallel to the plane of the target rail and the plane of the endless track of the conveyor.

15. The automatic target device of claim 1, further comprising a deflector plate attached to the frame so as to shield the device from projectiles, except for the at least one target as it passes along the target track.

16. The automatic target device of claim 15 wherein the deflector plate is canted so as to downwardly deflect projectiles received from the projectile source.

17. The automatic target device of claim 16, further comprising a first projectile trap disposed below said deflector plate so as to catch projectiles downwardly deflected by said deflector plate.

18. The automatic target device of claim 17, further comprising a peripheral projectile trap attachable to the frame and configured so as to catch projectiles that pass by the target and deflector plate laterally.

19. The automatic target device of claim 18, further comprising a means for funneling projectiles from the first projectile trap and the peripheral projectile trap into a container.

20. The automatic target device of claim 1, further comprising:

at least one drive pulley connected to the frame, connected to the source of motive power, and rotatable about an axis, wherein said drive pulley has an outer circumferential surface having a centrally disposed recess therein for receiving the conveyor so as to maintain stable alignment of the conveyor with the drive pulley;

at least one idler pulley connected to the frame and rotatable about an axis, wherein said idler pulley has an outer circumferential surface having a centrally disposed recess therein for receiving the conveyor so as to maintain stable alignment of the conveyor with the idler pulley.

21. The automatic target device of claim 20 wherein:

the conveyor comprises a standard link chain;

the recess in the drive pulley forms a groove for receiving links of the chain;

the recess in the idler pulley forms a groove for receiving links of the chain; and the target device further comprises a conveyor guide proximal to at least a portion of the target track of the conveyor, said guide having a channel in which the chain moves so as to provide torsional and lateral support for the chain, wherein a transverse cross section of the channel has subchannels disposed at right angles to each other, each subchannel for receiving links of the chain.

22. The automatic target device of claim 20, further comprising an adjustable suspension means for absorbing shock and transient loads in the conveyor and for adjusting tension in the conveyor.

23. The automatic target device of claim 20 wherein the source of motive power comprises a variable speed electric drive motor attached to the frame, adapted for electrical connection to an electric power source, and connected to the drive pulley so as to rotate the drive pulley.

24. The automatic target device of claim 23 wherein the motive source is remotely controllable.

25. The automatic target device of claim 23 wherein the gear reduction system provides 20:1 gear reduction.

26. The automatic target device of claim 23 wherein the variable speed electric drive motor is adapted for electrical connection to a DC electric power source.

27. The automatic target device of claim 26 wherein the DC electric power source is a 12 volt DC power source.

28. The automatic target device of claim 4, further comprising:

at least one hollow cylindrical sleeve attached to a link of the chain of the conveyor, said sleeve for hingedly receiving the connector end of the target.

29. The automatic target device of claim 28 wherein the connector end of the target comprises an axial rod for hingedly connecting to the conveyor.

30. The automatic target device of claim 29 wherein the target end of the target comprises a target plate.

31. The automatic target device of claim 30 wherein the target further comprises at least one support rod extending radially from the axial rod, said support rod having a proximal end attached to the axial rod, a distal end attached to the target plate, and being shaped so that the target plate will be substantially vertical when an upright target is leaning against the target support portion of the target rail.

32. The automatic target device of claim 1 wherein the connector end of the target comprises an axial rod for hingedly connecting to the conveyor.

33. The automatic target device of claim 32 wherein the target end of the target comprises a target plate.

34. The automatic target device of claim 33 wherein the target further comprises at least one support rod extending radially from the axial rod, said support rod having a proximal end attached to the axial rod, a distal end attached to the target plate, and being shaped so that the target plate will be substantially vertical when an upright target is leaning against the target support portion of the target rail.

35. The automatic target device of claim 1 wherein the transition portion of the target track is shaped and positioned so as to cam the at least one target to its upright position as the target approaches the target track.

36. A method of presenting moving targets for target practice comprising:

providing a frame;

providing an endless loop conveyor system having an endless loop conveyor configured for movement around a predetermined endless track, a first portion of which is a target track and a second portion of which is a return track wherein the target track is higher than the return track;

mounting said endless loop conveyor system to the frame;

providing a source of motive power to drive the conveyor;

providing at least one target having a target end and a connector end;

hingedly connecting the target at its connector end to the conveyor so as to be rotatable between at least an upright position and a toppled position about an axis substantially parallel to its direction of movement along the track;

providing a target rail having a target support portion and a transition portion;

positioning the target support portion adjacent to the target track of the conveyor so that an upright target will lean forwardly thereon toward the projectile source and slide thereon as the target moves along the target track; and positioning the transition portion adjacent to at least a portion of the return track so that a passing target will lean and slide thereon in an upright position as it approaches the target track.

37. The method of claim 36, further comprising:

providing a slide pad; and positioning the slide pad adjacent to the target track of the conveyor so that a toppled target will lean backwardly and slide thereon as the target moves along the target track.

38. The method of claim 36, further comprising:

providing a conveyor guide having a channel shaped to receive the conveyor; and placing the conveyor guide proximal to at least a portion of the target track of the conveyor so that the conveyor moves through the channel so as to provide torsional and lateral support for the conveyor.

39. The method of claim 36 wherein the conveyor comprises a standard link chain.

40. The method of claim 36 wherein the target support portion of the target rail and the transition portion of the target rail form a continuous rail.

41. The method of claim 40 wherein the target rail is endless.

42. The method of claim 41 wherein the target rail is positioned relative to the conveyor so that an upright target will lean thereon as it moves along the entire endless track.

43. The method of claim 42 wherein the target rail is disposed circumferentially outwardly of the conveyor.

44. The method of claim 43 wherein the conveyor and the target rail each lie substantially in a respective plane.

45. The method of claim 44 wherein the plane of the target rail and the plane of the endless track of the conveyor are canted forwardly so that the target track is closer to the projectile source than the return track.

46. The method of claim 45 wherein the plane of the target rail and the plane of the endless track of the conveyor are parallel.

47. The method of claim 46, further comprising:

providing a deflector plate and attaching the deflector plate to the frame so as to shield the device from projectiles, except for the at least one target as it passes along the target track.

48. The method of claim 47 wherein the deflector plate lies in a forwardly canted plane so as to downwardly deflect projectiles received from the projectile source.

49. The method of claim 48 wherein the plane of the deflector plate is parallel to the plane of the target rail and the plane of the endless track of the conveyor.

50. The method of claim 36, further comprising:

providing a deflector plate and attaching the deflector plate to the frame so as to shield the device from projectiles, except for the at least one target as it passes along the target track.

51. The method of claim 50 wherein the deflector plate is canted so as to downwardly deflect projectiles received from the projectile source.

52. The method of claim 51, further comprising:

providing a first projectile trap and positioning said trap below the deflector plate so as to catch projectiles downwardly deflected by said deflector plate.

53. The method of claim 52, further comprising:

providing a peripheral projectile trap and attaching said trap to the frame wherein said trap is configured so as to catch projectiles that pass by the target and deflector plate laterally when it is attached to the frame.

54. The method of claim 53, further comprising:

providing a means for funneling projectiles from the first projectile trap and the peripheral projectile trap into a container.

55. The method of claim 36, further comprising:

providing at least one drive pulley and connecting it to the frame and to the source of motive power, wherein said drive pulley is rotatable about an axis and has an outer circumferential surface having a centrally disposed recess therein for receiving the conveyor so as to maintain stable alignment of the conveyor with the drive pulley; and providing at least one idler pulley and connecting it to the frame, wherein said idler pulley is rotatable about an axis and has an outer circumferential surface having a centrally disposed recess therein for receiving the conveyor so as to maintain stable alignment of the conveyor with the idler pulley.

56. The method of claim 55 wherein:

the conveyor comprises a standard link chain, the recess in the drive pulley forms a groove for receiving links of the chain, and the recess in the idler pulley forms a groove for receiving links of the chain; and the method further comprising:

providing a conveyor guide having a channel for receiving the chain, wherein a transverse cross section of the channel has subchannels disposed at right angles to each other for receiving links of the chain, and positioning the guide proximal to at least a portion of the target track of the conveyor so that the chain moves through the channel so as to provide torsional and lateral support for the chain.

57. The method of claim 55, further comprising:

providing an adjustable suspension means for absorbing shock and transient loads in the conveyor and for adjusting tension in the conveyor.

58. The method of claim 55 wherein the source of motive power comprises:

a variable speed electric drive motor having a rotary drive shaft, attached to the frame and adapted for electrical connection to an electric power source; and a motor gear reduction system connected to the drive shaft and to the drive pulley so as to transmit power from the drive shaft to the drive pulley.

59. The method of claim 58 wherein the motive source is remotely controllable.

60. The method of claim 58 wherein the gear reduction system provides about 20:1 gear reduction.

61. The method of claim 58 wherein the variable speed electric drive motor is adapted for electrical connection to a DC electric power source.

62. The method of claim 61 wherein the DC electric power source is a 12 volt DC power source.

63. The method of claim 39, further comprising:

providing at least one hollow cylindrical sleeve attached to a link of the chain of the conveyor, said sleeve for hingedly receiving the connector end of the target.

64. The method of claim 63 wherein the connector end of the target comprises an axial rod for hingedly connecting to the conveyor.

65. The method of claim 64 wherein the target end of the target comprises a target plate.

66. The method of claim 65 wherein the target further comprises at least one support rod extending radially from the axial rod, said support rod having a proximal end attached to the axial rod, a distal end attached to the target plate, and being shaped so that the target plate will be substantially vertical when an upright target is leaning against the target support portion of the target rail.

67. The method of claim 36 wherein the connector end of the target comprises an axial rod for hingedly connecting to the conveyor.

68. The method of claim 67 wherein the target end of the target comprises a target plate.

69. The method of claim 68 wherein the target further comprises at least one support rod extending radially from the axial rod, said support rod having a proximal end attached to the axial rod, a distal end attached to the target plate, and being shaped so that the target plate will be substantially vertical when an upright target is leaning against the target support portion of the target rail.

70. The method of claim 36 wherein the transition portion of the target track is shaped and positioned so as to cam the at least one target to its upright position as the target approaches the target track.

* * * * *